US007325699B2

(12) United States Patent
Etheridge et al.

(10) Patent No.: US 7,325,699 B2
(45) Date of Patent: Feb. 5, 2008

(54) LINT-REDUCING CONTAINER

(75) Inventors: Sara Marie Etheridge, Menasha, WI (US); David Lewis Myers, Cumming, GA (US); Daphne Lynn VanBuren, Greenville, WI (US); Kathy Geralyn Richardson, Combined Locks, WI (US); Tammy Jo Balzar, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 62 days.

(21) Appl. No.: 11/017,028

(22) Filed: Dec. 17, 2004

(65) Prior Publication Data

US 2006/0151516 A1 Jul. 13, 2006

(51) Int. Cl.
*A45K 10/24* (2006.01)

(52) U.S. Cl. ..... 221/45; 221/33; 221/46; 221/135; 15/1

(58) Field of Classification Search ..... 221/1–312 C
See application file for complete search history.

(56) References Cited

U.S. PATENT DOCUMENTS 3,802,817 A 4/1974 Matsuki et al.
3,849,241 A 11/1974 Butin et al.
3,859,421 A 1/1975 Hucke
4,041,203 A 8/1977 Brock et al.
4,100,324 A 7/1978 Anderson et al.
4,215,682 A 8/1980 Kubik et al.
4,340,563 A 7/1982 Appel et al.
4,375,718 A 3/1983 Wadsworth et al.
5,188,885 A 2/1993 Timmons et al.
5,227,242 A 7/1993 Walter et al.
5,325,992 A * 7/1994 Koller et al. ..... 221/63
5,350,624 A 9/1994 Georger et al.
5,382,400 A 1/1995 Pike et al.
5,401,446 A 3/1995 Tsai et al.
5,482,765 A 1/1996 Bradley et al.
5,597,645 A 1/1997 Pike et al.
5,652,048 A 7/1997 Haynes et al.
5,709,735 A 1/1998 Midkiff et al.

(Continued)

FOREIGN PATENT DOCUMENTS

JP 09-313399 A 12/1997

(Continued)

OTHER PUBLICATIONS

Bauer-Gogonea, Simona, "Charging and Poling of Polymers," available at Internet web page "http://www.somap.jku.at/SoMaP-Dateien/home-Dateien/research-Dateien/charpol.HTM#charpol", dated Jun. 10, 1998, 4 pages.

(Continued)

*Primary Examiner*—Gene O. Crawford
*Assistant Examiner*—Michael K Collins
(74) *Attorney, Agent, or Firm*—Gregory E. Croft

(57) ABSTRACT

An electrostatically charged polymeric material, such as a polyolefin non-woven web, can be used in conjunction with a container, such as a tissue carton, for example, to attract lint and reduce the amount of lint that is deposited on the surface area surrounding the carton when the tissues are dispensed.

16 Claims, 5 Drawing Sheets

U.S. PATENT DOCUMENTS

| | | | | |
|---|---|---|---|---|
| 5,721,180 | A | 2/1998 | Pike et al. | |
| 5,721,883 | A | 2/1998 | Katsuo et al. | |
| 5,759,649 | A * | 6/1998 | Dinter et al. | 428/35.3 |
| 6,365,088 | B1 | 4/2002 | Knight et al. | |
| 6,536,132 | B2 * | 3/2003 | Helmer | 34/82 |
| 6,550,639 | B2 * | 4/2003 | Brown et al. | 221/135 |
| 6,560,335 | B2 | 5/2003 | Zohn et al. | |
| 6,565,958 | B1 | 5/2003 | Weder | |
| 6,699,310 | B2 | 3/2004 | Oda et al. | |
| 2002/0100494 | A1 | 8/2002 | Brown et al. | |
| 2004/0043838 | A1 | 3/2004 | Isogawa et al. | |
| 2004/0044183 | A1 | 3/2004 | Eckert et al. | |

FOREIGN PATENT DOCUMENTS

| | | | |
|---|---|---|---|
| JP | 10-113302 | A | 5/1998 |
| WO | WO 95/13856 | A1 | 5/1995 |
| WO | WO 96/13319 | A1 | 5/1996 |
| WO | WO 97/23246 | A2 | 7/1997 |
| WO | WO 00/63669 | A1 | 10/2000 |
| WO | WO 01/03802 | A1 | 1/2001 |

OTHER PUBLICATIONS

Giacometti, José A. et al., "Corona Charging of Polymers: Recent Advances on Constant Current Charging," *Brazilian Journal of Physics*, vol. 29, No. 2, Jun. 1999, pp. 269-279.

Myers, David L. and B. Dean Arnold, "Electret Media for HVAC Filtration Applications," *International Nonwovens Journal*, vol. 12, No. Winter 2003, pp. 43-54.

"Photovoltaic Solar Energy," TNO Chemistry, The Netherlands, Internet web page "http://www.chemie.tno.nl/research_and_technologies/polymers_and_coatings/polymers_synthesis/polymers_synthesis_solar_energy.html", viewed and printed Jun. 3, 2004, 3 pages.

* cited by examiner

LINT-REDUCING CONTAINER

BACKGROUND OF THE INVENTION

A common complaint of facial tissue consumers is the deposition and accumulation of lint on the surface area surrounding the tissue carton as a result of dispensing the tissues. Lint consists primarily of very small fibrous particle fragments and short fibers that are created during tissue manufacturing or which are created by frictional forces as the tissue sheets are dispensed. Over the years as tissue products have become softer, such as through better creping or the use of chemical debonders, for example, the level of lint associated with such products has increased. Pop-up style tissue cartons, which contain an interleaved or interfolded clip of tissues and have a flexible poly window through which the tissues are dispensed, are particularly problematic because the tissue sheets undergo considerable frictional forces as they are disengaged from their interfolded clip configuration within the carton and are withdrawn through the poly window.

Therefore there is a need for a tissue carton that reduces the amount of lint that is deposited on the surfaces surrounding the carton during dispensing.

SUMMARY OF THE INVENTION

It has now been discovered that the amount of lint that exits the dispensing carton can be reduced by providing an electrostatically charged polymeric material in association with the carton that attracts and retains some or all of the lint. The electrostatically charged polymeric material, which can be a woven or non-woven sheet or other suitable film-like material, exhibits an external electric field due to the presence of imbedded charge or the orientation of dipoles within the polymer. Thus, as a tissue containing lint particles is withdrawn from its carton, instead of releasing the lint and dust into the surrounding air, at least some of the lint and dust is attracted to the electrostatically charged polymeric material and retained by the carton.

Hence, in one aspect, the invention resides in a container having a dispensing opening for removal of products therefrom, said container comprising an electrostatically charged polymeric material. The electrostatically charged polymeric material is particularly advantageous for attracting and collecting lint that is emitted when the products are removed from the container through a dispensing opening. Examples of products that may emit lint during dispensing include, without limitation, facial or bath tissues, wipers, paper towels, table napkins, washcloths, mats (diaper, adult, kitchen, etc.), gloves, mitts, socks, face masks, pantiliners, etc. Suitable containers include cartons (such as are used for dispensing facial tissues and paper towels), canisters, roll dispensers, trays, pop-up dispensers, reach-in dispensers and the like.

The electrostatically charged polymeric material can be positioned within the container in several different ways. In one embodiment, the electrostatically charged polymeric material can be placed between the product within the container, such as a tissue stack, and the inner container sidewalls, preferably in such a manner to substantially surround the product within the container, in order to capture lint that might settle within the container and otherwise be carried out of the container by the product during dispensing. In another embodiment, the electrostatically charged polymeric material can be present as a coating on the inside surface(s) of the container. In another embodiment, the electrostatically charged polymeric material can be a sheet positioned to substantially surround the dispensing opening, preferably positioned to contact the products as they are withdrawn from the container. A convenient arrangement is to simply provide a dispensing slit in the electrostatically charged polymeric material. However, the electrostatically charged polymeric material can also substantially surround the dispensing opening by providing separate strips of material on opposite sides of the dispensing opening. In such cases, the electrostatically charged polymeric material can be used alone or in combination with poly film. Alternatively, the electrostatically charged material can be positioned in close proximity to the dispensing opening sufficient to attract airborne lint, but not in contact with the product being dispensed. This can be advantageous in those instances where the electrostatically charged material is of a texture that might increase lint emission during dispensing as compared to other materials, such as a smooth flexible film. All of the foregoing embodiments can be employed alone or in combination with each other.

In a more specific aspect, the invention resides in a product comprising a dispensing carton containing a stack of tissues and a dispensing opening through which the tissues are dispensed, said product further comprising an electrostatically charged polymeric material which contacts the tissues within the carton and/or during dispensing.

Electrostatically charged polymeric materials that exhibit an externally measurable electric field in the absence of any applied electric field are known as electrets. Electrets formed by the implantation of positive and negative charges into a polymeric material are known as space charge electrets. An example of a space charge electret is a polypropylene film which has been charged by exposure to a positive corona discharge in air. The polypropylene film electret will exhibit a positive surface potential on the side of the film that was facing the positive electrode of the corona charging device and the opposite side of the film will exhibit a negative surface potential. Electrets which exhibit surface potentials of the same polarity as the charging electrodes are further known as homocharge electrets. Electrets formed due to the orientation of polar domains within the polymer are known as dipolar electrets. An example of a dipolar electret is polyvinylidene difluoride. If a polyvinylidene diflouride film is charged in a positive corona discharge in air, the surface potential will initially have positive polarity as in the homocharge electret described above. However, as the carbon-fluorine dipoles re-orient themselves, the surface potential will change polarity becoming negative on the side facing the positive electrode and positive on the side facing the negative electrode. Dipolar electrets that exhibit surface potentials of polarity opposite to that of the charging electrodes are further known as heterocharge electrets.

The electric field due to an electret is rarely homogeneous. Most often, the distribution of charge, or the re-orientation of dipoles, gives rise to an inhomogeneous electric field in the space surrounding the electret. An inhomogeneous electric field is characterized by the gradient of the electrical potential. In the case of a film electret, the potential gradient is beneficial in that it allows both charged and non-charged particulates to be directed to the surface of the polymer electret for capture. In the case of a non-woven electret, the inhomogeneity of the electret field can be quite large. The large potential gradients present in the volume surrounding the non-woven electret enable it to alter the trajectories of airborne debris, such as tissue lint, enhancing its capture.

For purposes of this invention, suitable polymeric materials which can be electrostatically charged to form an electret include, but are not limited to, polyolefins, polyamides, polyesters, polyurethanes, polydienes, polyols, polyethers, polycarbonates and other like polymers. As used herein the term "polymer" generally includes, but is not limited to: homopolymers; copolymers, such as, for example, block, graft, random and alternating copolymers; terpolymers; other multi-monomer polymers; and blends and modifications of any of the foregoing. Furthermore, unless otherwise specifically limited, the term "polymer" includes all possible spatial or geometrical configurations of the molecule. These configurations include, but are not limited to, isotactic, syndiotactic and random symmetries. Desirably, the thermoplastic polymer comprises polyolefin or polyamide polymers and, even more desirably, comprises non-polar polymers, such as polyolefins, particularly polyethylene and/or polypropylene polymers. Those skilled in the polymer arts will appreciate that the particular composition of the polymer or polymers will vary with respect to the chosen process for making the dust collection medium. As an example, the desired polymer rheology will be different for those polymers selected for making films as compared to those selected to make fibers. Similarly, the desired polymer composition and rheology can differ for polymers to be used for making spunbond fibers as compared to those to be used for making meltblown fibers. The desired polymer composition and/or rheology for a particular manufacturing process are well known to those skilled in the art.

Particularly suitable non-woven materials include meltblown fiber webs. Meltblown fibers are generally formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter. Thereafter, the meltblown fibers can be carried by the high velocity gas stream and are deposited on a collecting surface to form a web of randomly dispersed meltblown fibers. Meltblown processes are disclosed, for example, in U.S. Pat. No. 3,849,241 to Butin et al., U.S. Pat. No. 5,721,883 to Timmons et al., U.S. Pat. No. 3,959,421 to Weber et al., U.S. Pat. No. 5,652,048 to Haynes et al., U.S. Pat. No. 4,100,324 to Anderson et al. and U.S. Pat. No. 5,350,624 to Georger et al., all of which are herein incorporated by reference in their entirety. The meltblown fiber webs having small average fiber diameter and pore size, such as those described in U.S. Pat. No. 5,721,883 to Timmons et al., are particularly well suited for use in accordance with this invention. Meltblown fiber webs having a basis weight from about 15 to about 170 grams per square meter (gsm), more specifically from about 15 to about 135 gsm, are particularly well suited for use in accordance with this invention.

In addition, various spunbond fiber webs are also particularly suitable for providing good lint capture in accordance with this invention. Methods of making suitable spunbond fiber webs include, but are not limited to, U.S. Pat. No. 4,340,563 to Appel et al., U.S. Pat. No. 3,802,817 to Matsuki et al., U.S. Pat. No. 5,382,400 to Pike et al., U.S. Pat. No. 5,709,735 to Midkiff et al., U.S. Pat. No. 5,597,645 to Pike et al., PCT Application No. US94/12699 (Publication No. WO95/13856), PCT Application No. US95/13090 (Publication No. WO96/13319) and PCT Application No. US96/19852 (Publication No. WO97/23246), all of which are herein incorporated herein by reference in their entirety. Spunbond fiber webs particularly suitable for use in accordance with this invention desirably have a basis weight from about 15 to about 170 gsm and, more specifically, from about 15 to about 135 gsm.

Staple fiber webs, such as air-laid or bonded/carded webs, are also suitable for purposes of this invention. An exemplary staple fiber web is described in U.S. Pat. No. 4,315,881 to Nakajima et al., herein incorporated herein by reference.

Other materials suitable for use in accordance with this invention include multilayer laminates, such as multilayer non-woven laminates. Particularly suitable multilayer non-woven laminates include those in which some of the layers are spunbond webs and some are meltblown webs, such as a spunbond/meltblown/spunbond (SMS) laminate. Such a laminate may be made by sequentially depositing onto a moving forming belt a spunbond web layer, a meltblown web layer and another spunbond web layer. The resulting laminate is then bonded together, such as by thermal point bonding. Alternatively, the various web layers may be made individually, collected in rolls, unwound and thereafter combined in a separate bonding step. Examples of multilayer non-woven laminates are disclosed in U.S. Pat. No. 5,721,180 to Pike et al., U.S. Pat. No. 4,041,203 to Brock et al., U.S. Pat. No. 5,188,885 to Timmons et al. and U.S. Pat. No. 5,482,765 to Bradley et al., all of which are hereby incorporated by reference.

Particularly suitable film materials include polyolefins, especially polypropylene, poly-vinyl halides, poly-vinylidene halides and copolymers thereof, especially polyvinylidene difluoride and Saran®.

The polymeric material can be electrostatically charged by any suitable electret treating technique known in the art. Suitable electret treating processes include, but are not limited to, plasma-contact, electron beam, corona discharge and the like. Electret treatment can be applied to the polymeric material during or after the film or web formation. By way of examples, methods for electret treating fabrics are disclosed in U.S. Pat. No. 4,215,682 to Kubic et al., U.S. Pat. No. 4,375,718 to Wadsworth et al., U.S. Pat. No. 5,401,446 to Tsai et al. and U.S. Pat. No. 6,365,088 B1 to Knight et al. All of the foregoing patents are herein incorporated herein by reference in their entirety.

Alternatively, electrostatic charging of the polymeric material can be accomplished using a passive charging process like triboelectric charging. Triboelectric charging is associated with the transfer of charge due to frictional contact between dissimilar dielectric materials. Triboelectric charging is composed of kinetic and equilibrium components. The kinetic component arises from the energy dissipated when two dissimilar materials are rubbed together. This leads to frictional heating at the area of contact, and thus charge transfer between the materials. The equilibrium component is also known as contact electrification. This arises from static contacts between different dielectric materials, leading to a transfer of charge. It is widely believed that contact electrification is affected by the relative electron affinities of the two contacting materials and differences in their work functions. Both of these quantities are related to how tightly bound electrons are to their respective nuclei. A triboelectric series has been created in which materials range from those that are electron-accepting to those that are electron-donating, thereby enabling one to choose materials with electron transfer properties that are complimentary. For example, cellulose and polypropylene are found at opposite ends of the triboelectric series. Thus, it is reasonable to assume that the frictional contact between a tissue and the dispensing mechanism of the tissue carton would be sufficient to cause charging of each substrate. Triboelectric charging would occur during removal of the tissue from the carton, thereby providing an active mechanism for the electrostatic capture of lint particles.

The electrostatically charged polymer materials useful for purposes of this invention can be characterized by measurement of surface potential. More specifically, the electrostatically charged polymer materials useful for purposes of this invention can be characterized by a surface potential absolute value of about 50 volts or greater (the polarity of the surface potential can be either positive or negative), more specifically from about 50 to about 15,000 volts and still more specifically from about 50 to about 6000 volts. The surface potential can be measured using any suitable electrostatic voltmeter, such as the Monroe Electronics Model 279 Electrostatic Voltmeter and the Model 1034 end-viewing probe (Monroe Electronics, Lyndonville, N.Y.). The aforementioned meter has a useful range of −2000 to +2000 volts. For the measurement of surface potentials outside this range, the Trek Model 341A High Speed Electrostatic Voltmeter and the Model 3455ET end-viewing probe (Trek Inc., Medina, N.Y.) with a range of ±20,000 volts, or equivalent, is acceptable.

The accuracy of surface potential measurements is dependent on the reliability of the meter, the quality of the electrical contact between the sample being measured and ground, and the probe tip-to-sample spacing. Electrostatic voltmeters should be calibrated periodically by checking their measurement performance against a known surface voltage. This is easily accomplished by applying a known voltage to a metal plate (either copper (Cu) or aluminum (Al)) and checking the surface voltage over a range of probe tip-to-sample spacing. An example of data collected using the Monroe Electronics Model 279 (with Model 3455T probe) is shown in Table 1 below. The reference voltage was set at 400±5 volts (DC).

TABLE 1

(Surface Potential as a Function of Probe to Sample Spacing Measured for and Aluminum Plate at a Potential of +400 ± 5 volts)

| Probe to Sample Spacing (mm) | Surface Potential (V) |
|---|---|
| 1 | 401 |
| 2 | 404 |
| 3 | 405 |
| 4 | 405 |
| 5 | 405 |
| 7 | 399 |
| 9 | 395 |

Surface potential measurements of porous and fibrous materials, while straight forward to do, can be difficult to interpret. The surface potential measurement is made by placing the sample on a grounded metal plate (Cu or Al). The probe tip is held to within 3 millimeters (mm) of the sample surface. If the sample is charged, a surface potential (voltage) is detected by the probe. This causes the meter to apply a potential of opposite polarity to the probe in order to null (zero) the potential between the tip of the probe and the ground plane defined by the metal plate. Charged fibrous or porous materials will exhibit a broad range of surface potential as the measured voltage is dependent on the distance from the top of the sample to the ground plane. Thus, a low loft or thin sample (thickness of 1-2 mm) may have a surface potential with an absolute value of 50 to 100 volts, whereas if the sample is a high loft (thickness >5 mm) the measured potential may be as high as 10,000 to 15,000 volts. The surface potential should be measured at a minimum of ten (10) distinct points on the sample, preferably a minimum of twenty-five (25) distinct points on the sample. The surface potential is reported as the mean value plus/minus one standard deviation from the mean.

While there is no widely accepted "standard" for surface potential measurements, commercially available polytetrafluoroethylene (PTFE) tape serves as a good standard material for checking the accuracy of surface potential measurements. In a typical test, four strips of PTFE tape about 10 centimeters (cm) in length, 1.2 cm in width, and 0.01 cm in thickness are placed on a metal plate (Cu or Al). The plate is connected to earth ground and the tapes are corona charged using pin-to-plate geometry between +20 kilovolts direct current (KVDC) and +25 KVDC for approximately 10 seconds. The surface potential of the electret charged tape strips are then measured as described above. In a typical test the surface potential of the obverse side of the charged PFTE taped will be from +1100 volts to +1600 volts depending on the actual charging potential used. If the tapes are removed from the metal plate and replaced such that the reverse side is facing the air, the surface potential of the charged tape will be from −800 volts to −1000 volts. Note that the polarity of the surface potential will change from positive to negative as the tape is inverted. If the tape is initially charged using a negative potential of −20 KVDC to −25 KVDC, the obverse surface will have a negative potential and the reverse surface a positive potential.

DETAILED DESCRIPTION OF THE DRAWINGS

Figure 1:
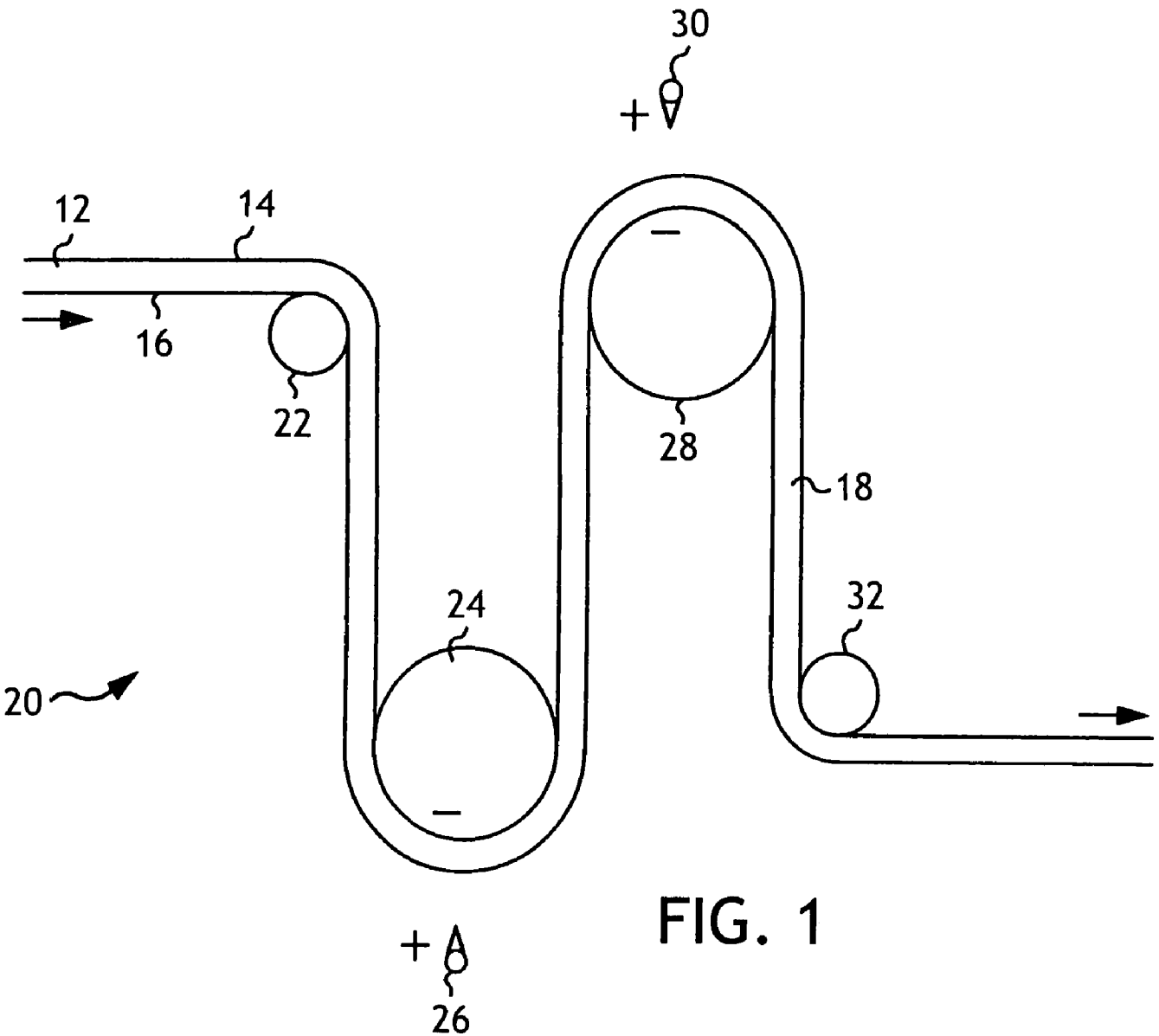
FIG. 1 illustrates one method for electrostatically charging a non-woven web for use in accordance with this invention.

Referring to FIG. 1, shown is a schematic flow diagram of a method for sequentially subjecting a sheet of polymeric material, such as a non-woven web, to a series of electric fields such that adjacent electric fields have opposite polarities with respect to one another. In general, a first side of the web is initially subjected to a positive charge while the second or opposed side of the web is subjected to a negative charge. Thereafter, the first side of the web is subjected to a negative charge and the second side of the web is subjected to a positive charge, resulting in permanent electrostatic charges being imparted to the web. More particularly, a non-woven web 12, having a first side 14 and a second side 16, is passed into an electretizing apparatus 20 with the second side 16 of the web in contact with guiding roller 22. The first side 14 of the web comes in contact with a first charging drum 24, which has a negative electrical potential, while the second side 16 of the web is adjacent a first charging electrode 26, which has a positive electrical potential. As the web 12 passes between the first charging drum and the first charging electrode, electrostatic charges are developed within the web. The web is then passed between a second charging drum 28 and a second charging electrode 30. The second side 16 of the web comes in contact with the second charging drum 28, which has a negative electrical potential, while first side 14 of the web is adjacent a second charging electrode 30, which has a positive electrical potential. The second treatment reverses the polarity of the electrostatic charges previously imparted within the web and creates a permanent electrostatic charge within the web. The electretized web 18 is then passed to a second guiding roller 32 and removed from electretizing apparatus.

By way of example, the electric fields for the above-described electretizing process can be effectively operated in a range of from about 1 to about 30 kilovolts direct current per centimeter (KVDC/cm) and, more specifically, from about 4 to about 20 KVDC/cm when the gap between the drum and the electrode is about 0.9 inch. However, it will be appreciated that the charging potentials useful in the electretizing processes can vary with the field geometry of the elements. It will be appreciated that other methods or apparatus could be utilized in lieu of those illustrated.

Figure 2:
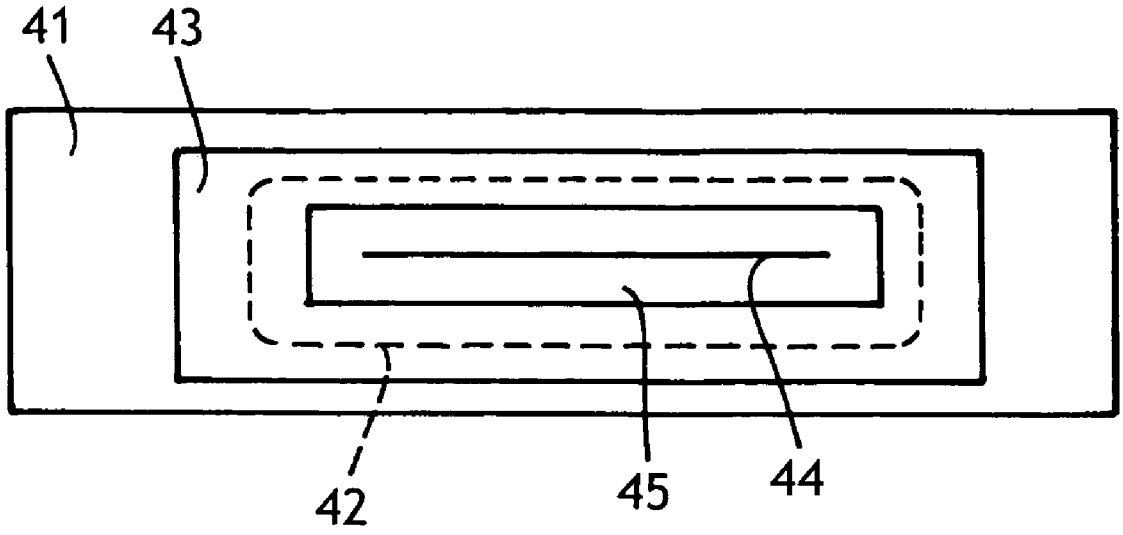
FIG. 2 is a schematic plan view of a tissue carton in accordance with this invention, illustrating the use of an electrostatically charged sheet in combination with a plastic film to surround the dispensing opening of the carton.

FIG. 2 is a schematic plan view of the top of a container, particularly a facial tissue carton, in accordance with this invention, as viewed from the inside of the carton. Shown is the top wall 41 of the carton, a carton opening 42 such as is commonly formed when the user first pulls away the perforated "surf board" of the facial tissue carton. Superimposed over the carton opening is a piece of poly film 43 glued to the inside of the carton. The poly film has a dispensing opening, such as slit 44, through which the tissues are dispensed. Overlaid on the poly film is an electrostatically charged polymeric material 45, such as a non-woven sheet, which also has a dispensing slit generally coinciding with the dispensing slit in the poly film. As tissues are withdrawn through the dispensing slits, lint is attracted to and adhered to the electrostatically charged polymeric non-woven material. While this embodiment of the invention illustrates a composite sheet dispensing opening having a combination of poly film and non-woven sheet, other combinations are also suitable, such as a single or multiple sheets of non-woven sheets only, or a sandwich construction of non-woven sheet/poly film/non-woven sheet, where the non-woven materials are electrostatically charged polymeric materials. In such sandwich constructions, the poly film can be electrostatically charged or not electrostatically charged.

Figure 2A:
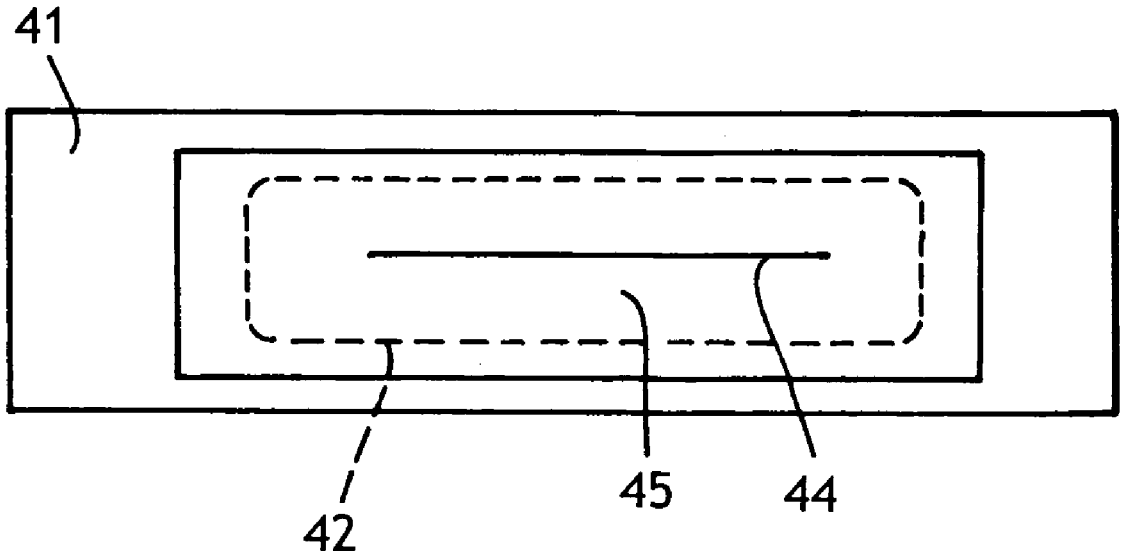
FIG. 2A is a view of a carton similar to that of FIG. 2, but having an electrostatically charged sheet covering the carton opening without the presence of a plastic film.

FIG. 2A is a schematic plan view of a carton in accordance with this invention, similar to that of FIG. 2, but not having a poly film present. In this embodiment, the electrostatically charged non-woven sheet 45 covers the carton opening 42 and is provided with a slit 44. The non-woven sheet can be adhered to the inside of the top wall with any suitable adhesive.

Figure 3:
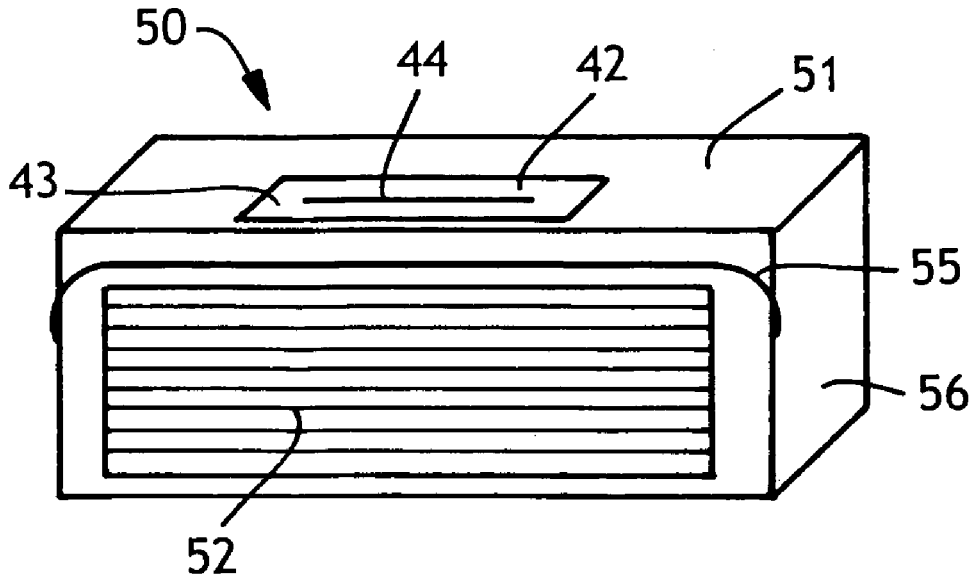
FIG. 3 is a schematic cut-a-way perspective view of a tissue carton in accordance with this invention, illustrating the use of an internal electrostatically charged material "sling" to cover the clip of tissues within the carton.

FIG. 3 is a schematic cut-a-way perspective view of a tissue carton in accordance with this invention, wherein a sheet or "sling" of the electrostatically charged polymeric material is overlaid on top of the tissue clip, as opposed to being part of the carton opening. Shown is the tissue carton 50 having a top wall 51 and a carton opening 42 through which tissues are dispensed. The carton contains a clip or stack of tissues 52 which are preferably interleaved for pop-up dispensing. An optional polyfilm 43 containing a slit 44 can cover the opening 42. On top of the clip is a sheet of the electrostatically charged polymeric material, such as a non-woven sheet 55 which is suitably attached to the inside carton walls 56 and 57 (not visible in this view), such as by adhesive.

Figure 3A:
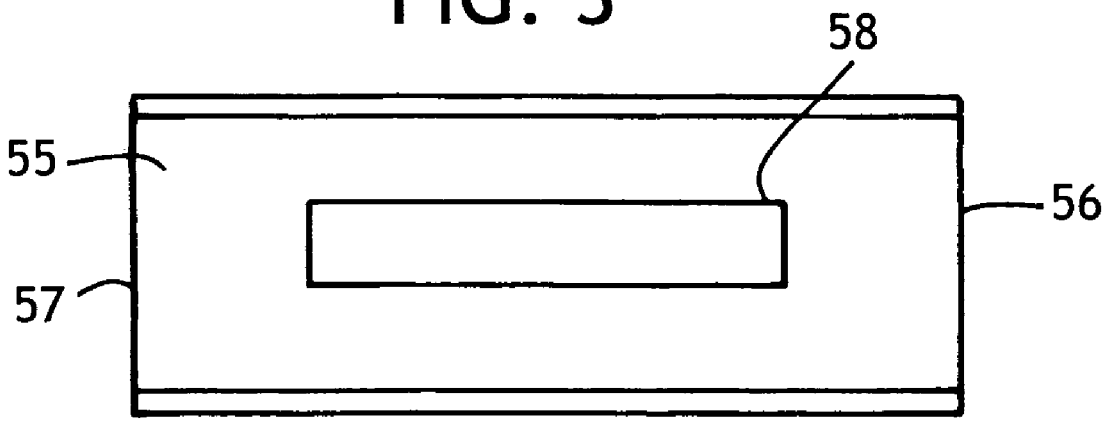
FIG. 3A is plan view of the carton of FIG. 3, illustrating one alternative for the shape of the sling.
Figure 3B:
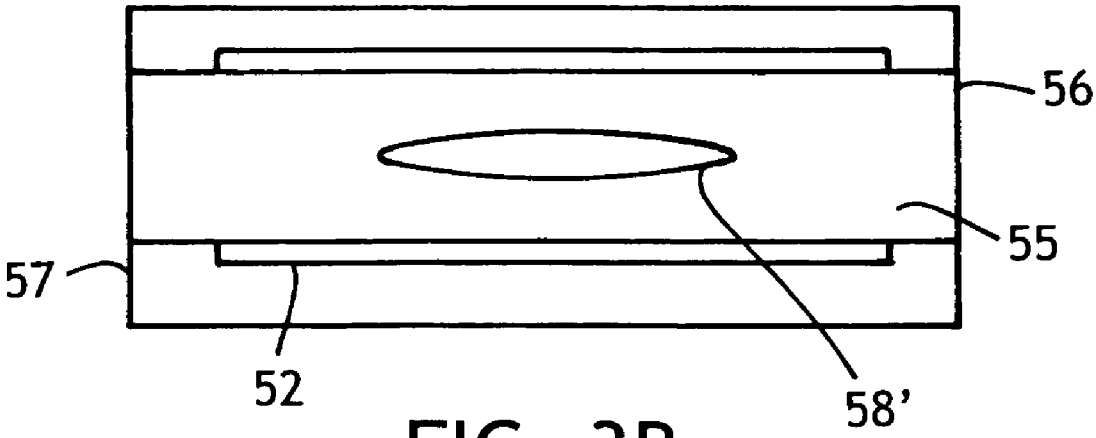
FIG. 3B is a plan view of the carton of FIG. 3, illustrating another alternative for the shape of the sling.

FIGS. 3A and 3B are plan views of the sling of FIG. 3, illustrating optional configurations. As shown in FIG. 3A, the sling completely covers the top of the tissue clip, except for a rectangular opening 58 through with the tissues pass en route to the carton dispensing opening. FIG. 3B shows a different configuration, in which the sling substantially covers the tissue clip. In this embodiment, the opening 58' in the sling is oval. Any shaped opening which allows the tissues to pass through is within the scope of this invention.

Figure 4:
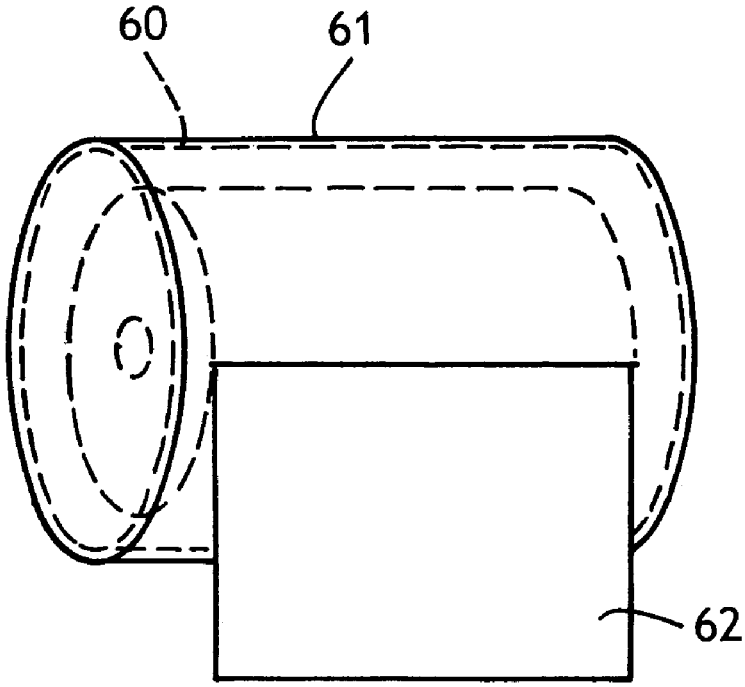
FIG. 4 is a schematic view of a container in accordance with this invention for dispensing roll products, such as bath tissue or paper towels.

FIG. 4 illustrates another embodiment of the invention, in which the electrostatically charged polymeric material is provided as a lining 60 on the inside surface of a dispensing container 61 for rolled product 62, such as bath tissue or paper towels. For re-usable containers, it is preferable that the electrostatically charged polymeric material be provided as a removable liner that can be replaced as needed. For cylindrical containers such as shown in this figure, the liner could be removed from either end of the container.

Figure 5:
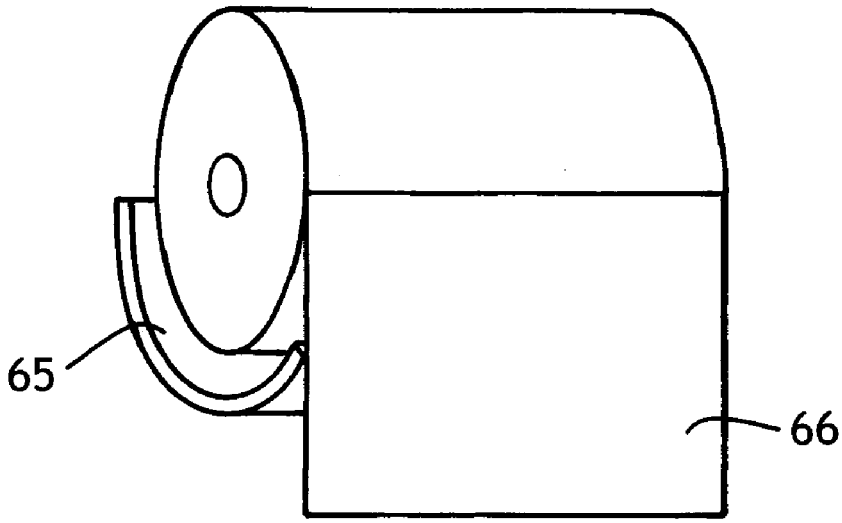
FIG. 5 is a schematic view of an alternative container in accordance with this invention comprising a tray to support a roll product during dispensing.

FIG. 5 illustrates another embodiment of a container in accordance with this invention, in which a tray 65 partially contains and supports the product 66 during dispensing. The tray can contain a coating of an electrostatically charged polymeric material or a removable liner which lays on top of the tray.

Figure 6:
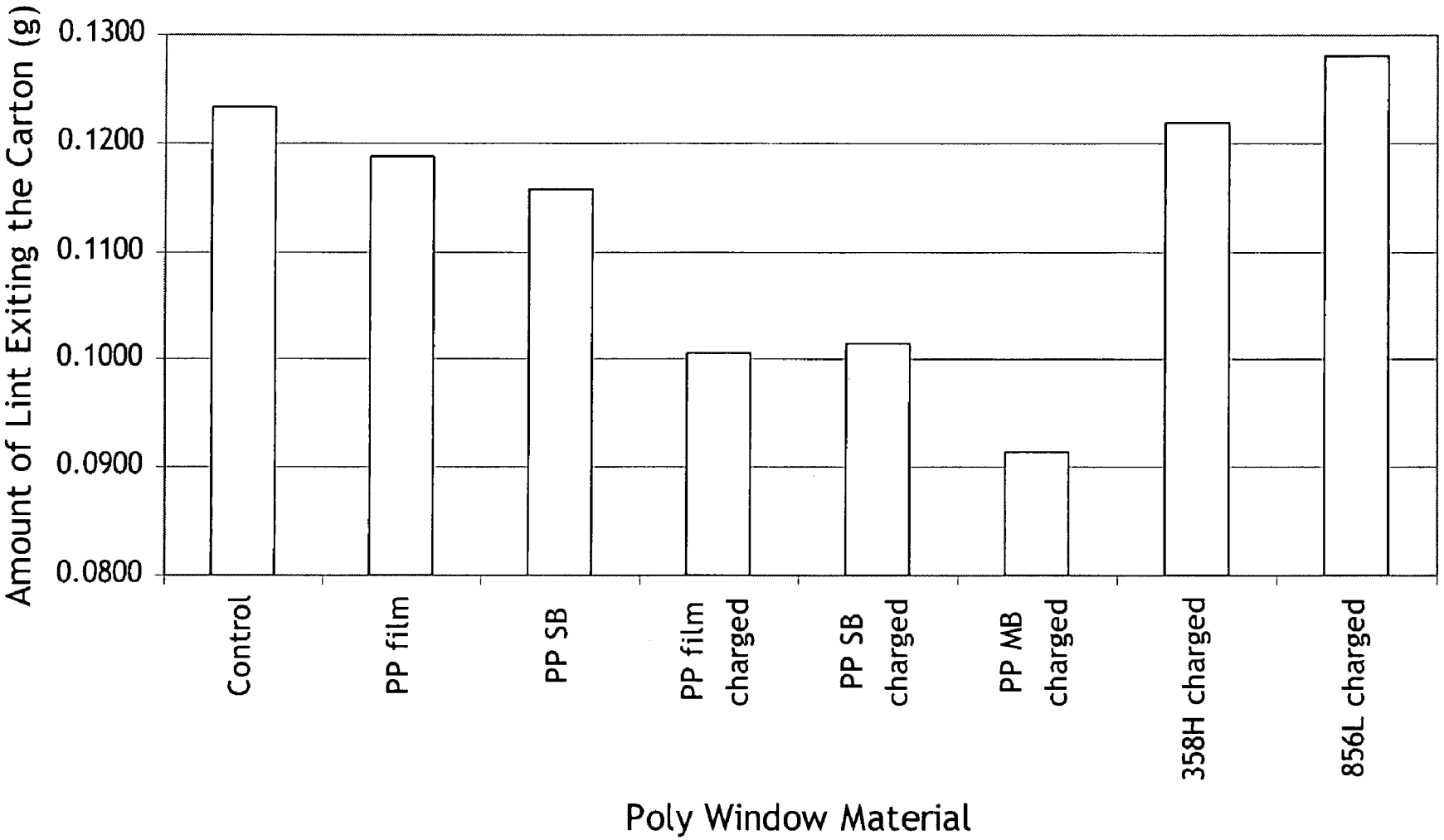
FIG. 6 is a bar chart summarizing the lint measurement results for Example 3.

FIG. 6 is a bar chart summarizing the results of Example 3 and will be further described in connection with the discussion of Example 3.

EXAMPLES

Example 1

A polypropylene point-bonded spunbond non-woven sheet having a basis weight of 1.25 ounces per square yard (osy) was electret charged using a pin-to-plate corona discharge in accord with the teachings of U.S. Pat. No. 6,365,088 B1 to Knight et al., previously mentioned and incorporated by reference. The charging voltage was +25 kV with a pin-to-plate spacing of 1.0 centimeter. The surface potential of the resulting sheet was 898 volts ±159 volts positive potential.

In order to prepare a tissue carton in accordance with this invention as illustrated in FIG. 2A, the tissue stack within a 275-count KLEENEX® family size tissue carton was carefully removed after tearing open the glued carton end flaps at one end of the carton. The plastic dispensing window was removed from the carton by finding a corner of the plastic window on the inside of the carton and gently pulling to detach the plastic window from the inside of the carton. Using double-sided tape, the inside perimeter of the dispensing opening was lined with the tape. A 3.5 inches×8 inches piece of the electret-charged spunbond non-woven web was placed over the dispensing opening from the inside of the carton and adhered to the tape. The non-woven web was provided with a dispensing slit of the same size as the slit in the plastic window that was removed. The adhesion of the spunbond material to the tape was sufficient to hold the spunbond material in place while the tissues were subsequently dispensed. After the spunbond material was secured over the dispensing opening, the stack of tissues was reinserted into the carton and the end flaps were glued to close the opened end.

The modified tissue carton of this invention was placed on an 18 inches×25 inches piece of black poster board. Similarly, a normal 275-count KLEENEX family size tissue carton (the control) was placed on an identical black poster board, ensuring that the two test cartons were sufficiently spaced apart to avoid contaminating the test results.

Holding down the top of each carton, all of the tissues in each carton were dispensed from start to finish using relatively consistent pulls of each tissue. Each of the dispensed tissues was immediately placed in a disposal container. After each carton was emptied, the amount of dust and lint on and around the box was observed and compared. The comparative test was repeated two times. Qualitative observations of each comparative test showed a reduction in the amount of dust and lint particles that landed on and around the carton of this invention as compared to the control carton.

Example 2

The comparative testing of Example 1 was repeated, except the electret-charged material of the carton of this invention was a polypropylene spunbond non-woven sheet having a basis weight of 0.5 ounces per square yard (osy) which was treated as described in Example 1. The surface potential of the resulting sheet was 58 volts±54 volts positive potential. As with Example 1, qualitative observations of each comparative test showed a reduction in the amount of dust and lint particles that landed on and around the carton of this invention as compared to the control.

Example 3

A tissue carton as described in connection with Example 1 was tested with a number of different dispensing opening materials in order to quantify their relative effectiveness in reducing lint during dispensing. The materials included a "Control", which was a 1 mil low-density polyethylene film. An untreated polypropylene film, designated "PP film", was a 50 micron polypropylene film. An untreated polypropylene spunbond material, designated "PP SB", was a 0.5 osy spunbond sheet. An electrostatically charged polypropylene film in accordance with this invention, designated "PP film charged", was a charged 50 micron polypropylene film having a surface potential of 5662±1300 volts. An electrostatically charged polypropylene spunbond sheet in accordance with this invention, designated "PP SB charged" was a charged 0.5 osy spunbond sheet having a surface potential of 898±159 volts positive potential. An electrostatically charged polypropylene meltblown material in accordance with this invention, designated "PP MB charged", was a 1.0 osy polypropylene charged meltblown sheet having a surface potential of 983±113 volts. An electrostatically charged sheet in accordance with this invention, designated "358H charged", was a 2.75 osy high loft bicomponent sheet having a surface potential of 2500±800 volts. An electrostatically charged sheet in accordance with this invention, designated "856L", was meltblown composite sheet having a surface potential of 500±300 volts.

Each of the test materials was incorporated into the tissue carton as described in Example 1 and a standard clip of 160 tissues was dispensed at a rate of approximately one tissue every 0.5 second. During dispensing, the tissue cartons were placed in an enclosed chamber from which air is continuously drawn through a weighed lint/dust collecting filter. Any airborne lint resulting from the act of dispensing the tissues was drawn into and trapped by the filter and weighed. At the end of each test, any additional dust/lint that remained on the interior walls of the chamber was carefully brushed off into the filter. Each test was repeated five times to obtain an average result. The results of the testing are set forth in Table 2 below and are summarized in the bar chart of FIG. 6.

TABLE 2

| | Control | PP film | PP SB | PP film charged | PP SB charged | PP MB charged | 358H charged | 856L charged |
|---|---|---|---|---|---|---|---|---|
| Rep 1 | 0.1302 | 0.1195 | 0.1166 | 0.0991 | 0.1185 | 0.0838 | 0.1056 | 0.1315 |
| Rep 2 | 0.134 | 0.1139 | 0.1013 | 0.0991 | 0.1112 | 0.1042 | 0.1383 | 0.1354 |
| Rep 3 | 0.1062 | 0.1254 | 0.118 | 0.0982 | 0.0996 | 0.0919 | NA | 0.1185 |
| Rep 4 | 0.1253 | 0.1099 | 0.1275 | 0.1034 | 0.0961 | 0.0928 | NA | 0.1257 |
| Rep 5 | 0.1209 | 0.1247 | 0.1155 | 0.1035 | 0.0822 | 0.0847 | NA | 0.1296 |
| Average | 0.1233 | 0.1187 | 0.1158 | 0.1007 | 0.1015 | 0.0915 | 0.1220 | 0.1281 |
| S.D. | 0.0108 | 0.0067 | 0.0094 | 0.0026 | 0.0140 | 0.0082 | 0.0231 | 0.0064 |
| Min | 0.1062 | 0.1099 | 0.1013 | 0.0982 | 0.0822 | 0.0838 | 0.1056 | 0.1185 |
| Max | 0.1340 | 0.1254 | 0.1275 | 0.1035 | 0.1185 | 0.1042 | 0.1383 | 0.1354 |
| % COV | 8.7362 | 5.638 | 8.1104 | 2.5566 | 13.8286 | 8.9588 | 18.9606 | 5.0124 |

As shown, for the sample materials for which an untreated material and a charged material were compared ("PP film" and "PP SB"), the charged material produced a lower amount of lint. The "PP MB charged" material produced even lower amounts of lint. Interestingly, the "358H charged" sample and the "856L charged" samples showed an increase in lint as compared to the control. This is attributed to the greater texture of these two materials relative to the Control, which is believed to have caused these two materials to actually increase the emission of lint during dispensing. Although no control was available to test, it is believed the uncharged control for these two materials would have exhibited even greater amounts of lint emission during dispensing.

It will be appreciated that the foregoing description and examples are given for purposes of illustration only and are not to be construed as limiting the scope of this invention, which is defined by the following claims and all equivalents thereto.

We claim:

1. A container having a dispensing opening for removal of lint-containing products therefrom, said container comprising a sheet of an electrostatically charged polymeric material positioned to substantially surround the dispensing opening as the products are removed from the container through the dispensing opening, said sheet of electrostatically charged polymeric material being electrostatically charged prior to being incorporated into the container, wherein lint released from the products during dispensing is attracted to and retained by the sheet of electrostatically charged polymeric material.

2. The container of claim 1 wherein the dispensing opening includes a slit in the electrostatically charged sheet.

3. A product comprising a dispensing carton containing a stack of tissues and a dispensing opening through which the tissues are dispensed, said product further comprising an electret electrostatically charged polymeric material adhered to the carton and which contacts the tissues within the carton during dispensing, said electret electrostatically charged polymeric material being electrostatically charged prior to being incorporated into the dispensing carton, wherein the tissues release lint during dispensing and the lint is attracted to and retained by the sheet of electrostatically charged polymeric material.

4. The product of claim 3 wherein the electrostatically charged material is a sheet positioned to substantially surround the dispensing opening.

5. The product of claim 3 wherein the dispensing opening comprises a slit in one or more sheets of electrostatically charged polymeric material.

6. The product of claim 3 wherein the dispensing opening consists of a slit in a single sheet of electrostatically charged polymeric material.

7. The container of claim 1 or the product of claim 3 wherein the electrostatically charged polymeric material is a film.

8. The container of claim 1 or the product of claim 3 wherein the electrostatically charged polymeric material has a surface potential absolute value of about 50 volts or greater.

9. The container of claim 1 or the product of claim 3 wherein the electrostatically charged polymeric material has a surface potential absolute value from about 50 to about 15,000 volts.

10. The container of claim 1 or the product of claim 3 wherein the electrostatically charged polymeric material has a surface potential absolute value from about 50 to about 6000 volts.

11. The container of claim 1 wherein the sheet of electrostatically charged polymeric material is electrostatically charged by corona discharge electret treatment.

12. The container of claim 1 wherein the sheet of electrostatically charged polymeric material is electrostatically charged by electron beam electret treatment.

13. The container of claim 1 wherein the sheet of electrostatically charged polymeric material is electrostatically charged by plasma contact electret treatment.

14. The product of claim 3 wherein the electret electrostatically charged polymeric material is electrostatically charged by corona discharge electret treatment.

15. The product of claim 3 wherein the electret electrostatically charged polymeric material is electrostatically charged by electron beam electret treatment.

16. The product of claim 3 wherein the electret electrostatically charged polymeric material is electrostatically charged by plasma contact electret treatment.

* * * * *